US012538973B2

(12) United States Patent
Gibbs et al.

(10) Patent No.: US 12,538,973 B2
(45) Date of Patent: Feb. 3, 2026

(54) MULTI-FUNCTIONAL CARRIER BAG

(71) Applicant: New Path Outdoors, LLC, Pengilly, MN (US)

(72) Inventors: Jeff Gibbs, Pengilly, MN (US); Kayla Johanna Gibbs, Pengilly, MN (US); Trisha Wookey, Bozeman, MT (US); Sky Sterry, Bozeman, MT (US)

(73) Assignee: New Path Outdoors, LLC, Pengilly, MN (US)

( * ) Notice: Subject to any disclaimer, the term of this patent is extended or adjusted under 35 U.S.C. 154(b) by 92 days.

(21) Appl. No.: 18/099,433

(22) Filed: Jan. 20, 2023

(65) Prior Publication Data

US 2023/0225486 A1 Jul. 20, 2023

Related U.S. Application Data

(63) Continuation-in-part of application No. 29/882,855, filed on Jan. 19, 2023, now Pat. No. Des. 1,073,298.

(60) Provisional application No. 63/301,259, filed on Jan. 20, 2022.

(51) Int. Cl.

| | |
|---|---|
| ***A45F 3/02*** | (2006.01) |
| *A45F 3/04* | (2006.01) |
| *A45F 3/16* | (2006.01) |
| *A45F 4/02* | (2006.01) |

(52) U.S. Cl.

CPC ..... *A45F 3/02* (2013.01); *A45F 2003/025* (2013.01); *A45F 3/047* (2013.01); *A45F 3/166* (2025.01); *A45F 2004/023* (2013.01)

(58) Field of Classification Search

CPC .... A45F 3/047; A45F 2004/023; A45F 3/166; A45F 2003/166

USPC ..... 224/578–581

See application file for complete search history.

(56) References Cited

U.S. PATENT DOCUMENTS

| | | | | |
|---|---|---|---|---|
| 5,911,406 | A * | 6/1999 | Winefordner | A45F 3/16 251/339 |
| 7,004,362 | B2 * | 2/2006 | Boone | A47D 13/025 224/628 |
| 7,070,077 | B2 * | 7/2006 | Egart | A45F 3/02 224/625 |
| 7,431,184 | B2 * | 10/2008 | Gregory | A45F 3/04 224/627 |

(Continued)

FOREIGN PATENT DOCUMENTS

| | | | |
|---|---|---|---|
| KR | 200387218 | Y1 * | 6/2005 |
| KR | 101185258 | B1 * | 9/2012 |

*Primary Examiner* — Scott T Mcnurlen

(74) *Attorney, Agent, or Firm* — Polsinelli PC

(57) ABSTRACT

Multi-functional carrying systems, methods, and devices include a multi-functional carrier bag with a central body from which a first stabilizer strap and a second stabilizer strap extend. The multi-functional carrier bag is usable in first carrying position with the central body positioned at a front of a user (e.g., a front torso or lap). The user can grab the second stabilizer strap and pull the multi-functional carrier bag across their body, rotating it until the central body is in a second carrying position at a rear of the user (e.g., on a back, upper torso). With the multi-functional carrier bag in the second carrying position, the second stabilizer strap extends from a side of the central body to attach to a strap connector disposed on the first stabilizer strap to form a three-point connection (e.g., a "T" connection) on a chest of the user.

16 Claims, 7 Drawing Sheets

(56) References Cited

U.S. PATENT DOCUMENTS

| | | | | |
|---|---|---|---|---|
| 8,322,585 | B2 * | 12/2012 | Herron | A45F 3/04 224/259 |
| 9,420,871 | B2 * | 8/2016 | Roberts | A45F 3/04 |
| D790,850 | S * | 7/2017 | Baldwin | D3/226 |
| 10,455,922 | B2 * | 10/2019 | Beck | A45F 3/08 |
| 11,388,976 | B2 * | 7/2022 | Espeland | A45F 3/04 |
| 11,490,715 | B2 * | 11/2022 | Jacobs | A45F 4/02 |
| 2003/0121945 | A1 * | 7/2003 | Lemanski, II | A45F 3/04 224/625 |
| 2009/0159629 | A1 * | 6/2009 | Lafoux | A45F 3/047 224/663 |
| 2010/0200632 | A1 * | 8/2010 | Lee | A45F 3/047 224/651 |
| 2011/0002094 | A1 * | 1/2011 | Blouin | A45F 5/021 361/679.01 |
| 2016/0015157 | A1 * | 1/2016 | Nouri | A45F 3/04 224/148.2 |
| 2019/0307232 | A1 * | 10/2019 | Nagai | A45F 3/04 |
| 2021/0100342 | A1 * | 4/2021 | Colorado | A45F 5/00 |

* cited by examiner

MULTI-FUNCTIONAL CARRIER BAG

CROSS-REFERENCE TO RELATED APPLICATIONS

This application is a continuation-in-part of and claims priority to U.S. Patent Application No. 29/882,855, filed Jan. 19, 2023 and titled "Carrying Bag;" and this application claims priority to Provisional Patent Application No. 63/301,259, filed Jan. 20, 2022 and titled "Multi-Functional Carrier Bag," the entireties of which are incorporated herein by reference.

FIELD

Aspects of the present disclosure generally relate to a multi-functional carrier bag and related systems and methods and, more particularly, to a bag that is transitionable between a plurality of carrying states during skiing or other activities.

BACKGROUND

Many people carry equipment in a backpack or similar bag while engaging in outdoor activities, such as skiing. To maximize freedom of movement during such activities, most bags are positioned on the back of the person. However, skiing often involves taking a lift chair to the top of a mountain, which can be challenging for people wearing such backpacks. More particularly, lift chairs are constantly in motion, with people sitting on the chair as it moves into position and, in some instances, a protective bar is lowered. Accordingly, skiers have to be mindful of the positioning of their bags to accommodate the moving chair and protective bar during a short time period. Many bags are cumbersome and challenging to maneuver, often resulting in problems ranging from an uncomfortable ride to disruption of the lift chair. It is with these observations in mind, among others, that the presently disclosed technology was conceived and developed.

SUMMARY

The aforementioned problems can be addressed using the technology disclosed herein. For instance, a multi-functional carrier bag can include a central body at least partially formed of a flexible material and/or a first stabilizer strap. The first stabilizer strap can include a first strap portion extending from a first end of the central body; and/or a second strap portion extending from a second end of the central body, the first strap portion and the second strap portion can form an obtuse angle. The multi-functional carrier bag can also include a second stabilizer strap extending from the central body at a side of the central body between the first end and the second end; and/or a pocket defined into the side of the central body. The pocket can be operable to receive and store the second stabilizer strap when the multi-functional carrier bag is in a first carrying position; and/or provide access to the second stabilizer strap when the multi-functional carrier bag is in a second carrying position.

In some examples, the first end includes a first strap sheath; the second end includes a second strap sheath; and/or the first strap sheath and the second strap sheath are continuous extensions of the flexible material at least partially forming the central body. Additionally, the multi-functional carrier bag can further comprise a zipper disposed on the central body with: a horizontal orientation in the first carrying position; and a non-horizontal orientation in the second carrying position. Moreover, the multi-functional carrier bag can further include a strap connector, disposed on the first stabilizer strap, for receiving a connector of the second stabilizer strap. The connector of the second stabilizer strap can be unattached to the strap connector when the multi-functional carrier bag is in the first carrying position; and/or attached to the strap connector when the multi-functional carrier bag is in the second carrying position. Also, the strap connector disposed on the first stabilizer strap can be a first strap connector; and the multi-functional carrier bag can further include a second strap connector disposed on a front surface of the central body.

In some instances, the connector of the second stabilizer strap couples to the second strap connector disposed on the front surface of the central body when the multi-functional carrier bag is in the first carrying position; and/or the connector strap couples to the first strap connector disposed on the first stabilizer strap when the multi-functional carrier bag is in the second carrying position. Furthermore, the first strap connector can be slidably disposed on the first stabilizer strap; and/or the second strap connector can be fixedly disposed on the front surface of the central body. The central body can include an irregular hexagonal-shaped profile.

In some examples, a multi-functional carrying system can include a central body at least partially formed of a flexible material; and/or a first stabilizer strap including a first strap portion extending from a first end of the central body; and a second strap portion extending from a second end of the central body. The multi-functional carrying system can also include a second stabilizer strap extending from the central body between the first end and the second end; and/or a pocket defined into a side of the central body operable to receive and store the second stabilizer strap when the multi-functional carrying system is in a first carrying position. The pocket can also be operable to provide access to the second stabilizer strap for transitioning the multi-functional carrying system from the first carrying position to a second carrying position. Additionally, the multi-functional carrying system can include a strap connector disposed on the first stabilizer strap for receiving a connector of the second stabilizer strap when the multi-functional carrying system is in the second carrying position.

In some instances, the connector is a magnetic connector, and the strap connector is a magnetic buckle corresponding to the magnetic connector, providing one-handed attachability for the strap connector. The second stabilizer strap can also include a V strap, with a first strap of the V strap coupling to the central body at a first connection point, and a second strap of the V strap coupling to the central body at a second connection point, and/or the pocket can be disposed adjacent to the V strap on the central body. Moreover, the first strap can intersect the second strap with a slidable connector which slides unencumbered along the second strap for automatic adjustments. Additionally or alternatively, the multi-functional carrying system further includes a first pocket configured for cell phone carrying, and a second pocket configured for a hand warmer, the second pocket having an interior foam divider separating the first pocket from the second pocket and preventing heat transfer from the hand warmer to a contents of the second pocket.

In some scenarios, a method of providing a multi-functional carrying system includes carrying a multi-functional carrying bag in a first carrying position. The multi-functional carrying bag can include a central body, a first stabilizer strap, and a second stabilizer strap; and/or the first carrying position can include a connector of the second stabilizer strap coupled to a corresponding strap connector disposed on the first stabilizer strap to form a three-point connection at a front torso of a user. The method can further include transitioning the multi-functional carrying bag from the first carrying position to a second carrying position by rotating the central body of multi-functional carrying bag from a back of a user to the front torso of the user. Additionally or alternatively, the method can include carrying the multi-functional carrying bag in the second carrying position. Moreover, the second carrying position can includes a first strap portion of the first stabilizer strap extending from a first end of the central body; a second strap portion of the first stabilizer strap extending from a second end of the central body; and/or the second stabilizer strap stowed in a pocket or removably coupled to the central body.

In some examples, the second carrying position includes the second stabilizer strap removably coupled to the central body by coupling a first magnetic connector disposed on the second stabilizer strap to a second magnetic connector disposed on an outer surface of the central body. Furthermore, the connector of the second stabilizer strap can couple to the corresponding strap connector using a magnetic connection between the connector and the strap connector. Transitioning the multi-functional carrying bag from the first carrying position to the second carrying position can also include performing a one-handed operation. Additionally, the method can also include accessing a hydration port, while carrying the multi-functional carrying bag in the second carrying position, disposed on a side of the multi-functional carrying bag opposite the pocket for stowing the second stabilizer strap. By way of example, transitioning the multi-functional carrying bag from the first carrying position to the second carrying position can include detaching the connector from the strap connector to disengage the three-point connection at the front torso of the user; and/or rotating the multi-functional carrying bag from a back upper torso of the user to the front torso of the user. Moreover, the method can further include preventing, with a foam liner disposed inside the multi-functional carrying bag, a heat distribution from a first pocket stowing a hand warmer to a second pocket for stowing a mobile device. Implementations described and claimed herein address the forgoing by providing multi-functional carrier bag systems and methods. Other implementations are also described and recited herein. Further, while multiple implementations are disclosed, still other implementations of the presently disclosed technology will become apparent to those skilled in the art from the following detailed description, which shows and describes illustrative implementations of the presently disclosed technology. As will be realized, the presently disclosed technology is capable of modifications in various aspects, all without departing from the spirit and scope of the presently disclosed technology. Accordingly, the drawings and detailed description are to be regarded as illustrative in nature and not limiting.

DETAILED DESCRIPTION

Figure 1:
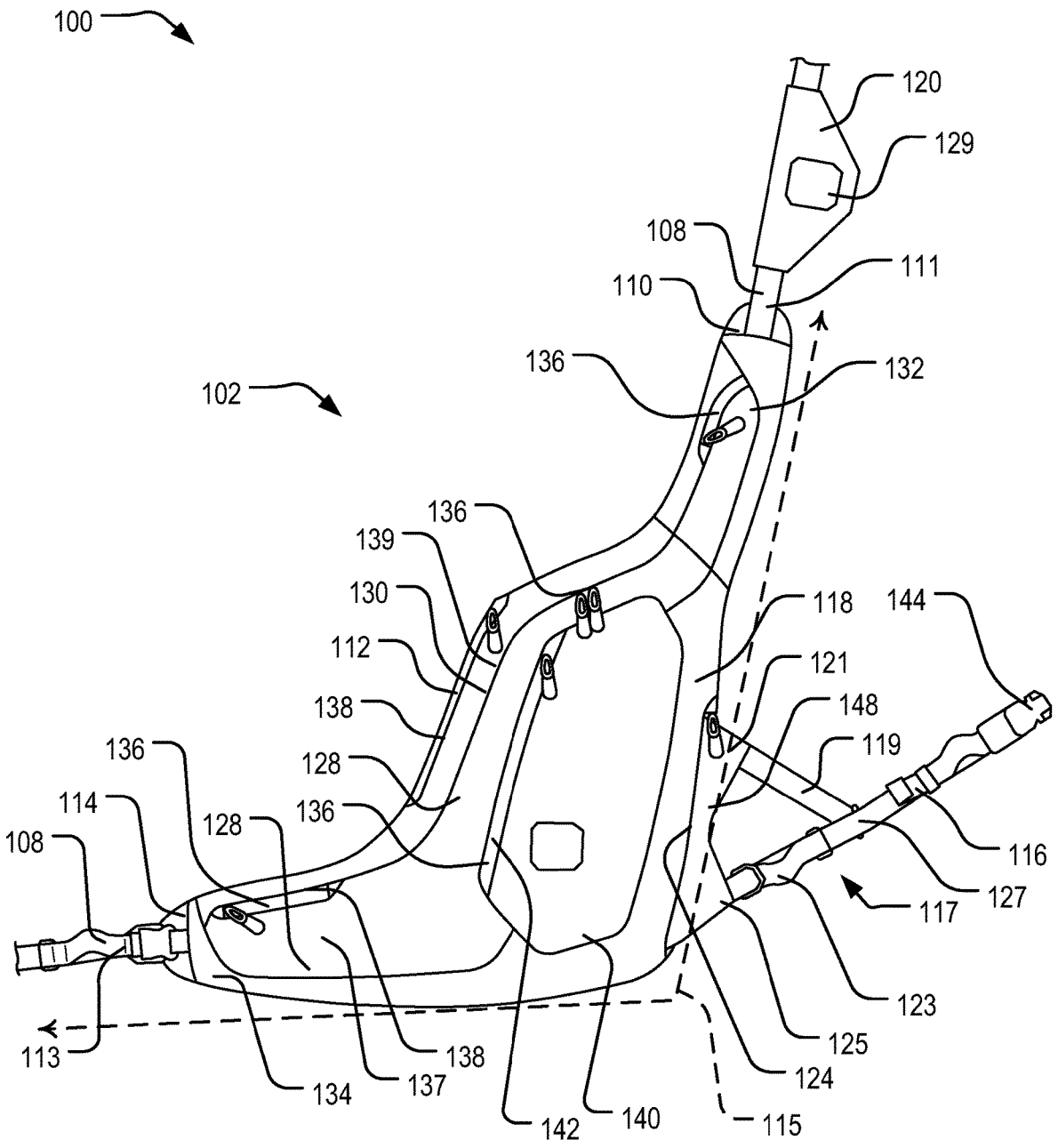
FIG. 1 illustrates a front side of an example multi-functional carrier bag with one or more carrying positions.

It will be appreciated that for simplicity and clarity of illustration, where appropriate, reference numerals have been repeated among the different figures to indicate corresponding or analogous elements. In addition, numerous specific details are set forth in order to provide a thorough understanding of the examples described herein. However, it will be understood by those of ordinary skill in the art that the examples described herein can be practiced without these specific details. In other instances, methods, procedures and components have not been described in detail so as not to obscure the related relevant feature being described. Also, the description is not to be considered as limiting the scope of the examples described herein. The drawings are not necessarily to scale and the proportions of certain parts may be exaggerated to better illustrate details and features of the present disclosure.

The phraseology and terminology employed herein are for the purpose of description and should not be regarded as limiting. For example, the use of a singular term, such as, "a" is not intended as limiting of the number of items. Further, it should be understood that any one of the features of the presently disclosed technology may be used separately or in combination with any other disclosed features. Other systems, methods, features, and advantages of the presently disclosed technology will be, or become, apparent to one with skill in the art upon examination of the figures and the detailed description. It is intended that all such additional systems, methods, features, and advantages be included within this description, be within the scope of the presently disclosed technology, and be protected by the accompanying claims.

Further, as the presently disclosed technology is susceptible to examples of many different forms, it is intended that the present disclosure be considered as an example of the principles of the presently disclosed technology and not intended to limit the presently disclosed technology to the specific arrangements shown and described. Any one of the features of the presently disclosed technology may be used separately or in combination with any other feature. References to the terms "instances," "scenarios," "examples," and/or the like in the description mean that the feature and/or features being referred to are included in, at least, one aspect of the description. Separate references to these terms and/or the like in the description do not necessarily refer to the same example and are also not mutually exclusive unless so stated and/or except as will be readily apparent to those skilled in the art from the description. For example, a feature, structure, process, step, action, or the like described in one example may also be included in other examples, but is not necessarily included. Thus, the presently disclosed technology may include a variety of combinations and/or integrations of the examples described herein. Additionally, all aspects of the present disclosure, as described herein, are not essential for its practice. Likewise, other systems, methods, features, and advantages of the presently disclosed technology will be, or become, apparent to one with skill in the art upon examination of the figures and the description. It is intended that all such additional systems, methods, features, and advantages be included within this description, be within the scope of the presently disclosed technology, and be encompassed by the claims.

Any term of degree such as, but not limited to, "substantially," as used in the description and the appended claims, should be understood to include an exact, or a similar, but not exact configuration. The terms "comprising," "including" and "having" are used interchangeably in this disclosure. The terms "comprising," "including" and "having" mean to include, but not necessarily be limited to the things so described.

Lastly, the terms "or" and "and/or," as used herein, are to be interpreted as inclusive or meaning any one or any combination. Therefore, "A, B, or C" or "A, B, and/or C" mean any of the following: "A," "B," or "C"; "A and B"; "A and C"; "B and C"; "A, B and C." An exception to this definition will occur only when a combination of elements, functions, steps or acts are in some way inherently mutually exclusive.

Aspects of the presently disclosed technology relate to a multi-functional carrier bag that can be carried in one or more positions on the body of a person. In one aspect, the multi-functional carrier bag includes various components that make the multi-functional carrier bag transitionable between different carrying positions with a simple one-handed operation of releasing a clasp/buckle and pulling on a strap. As such, the multi-functional carrier bag can be easily adaptable to many situations when the user is either mobile or stationary (e.g., sitting or resting). Various benefits can be realized in a multitude of activities, such as skiing, hiking, mountain climbing, walking, running, bicycling, boating, flying, and so forth, as discussed in greater detail below.

Figure 2:
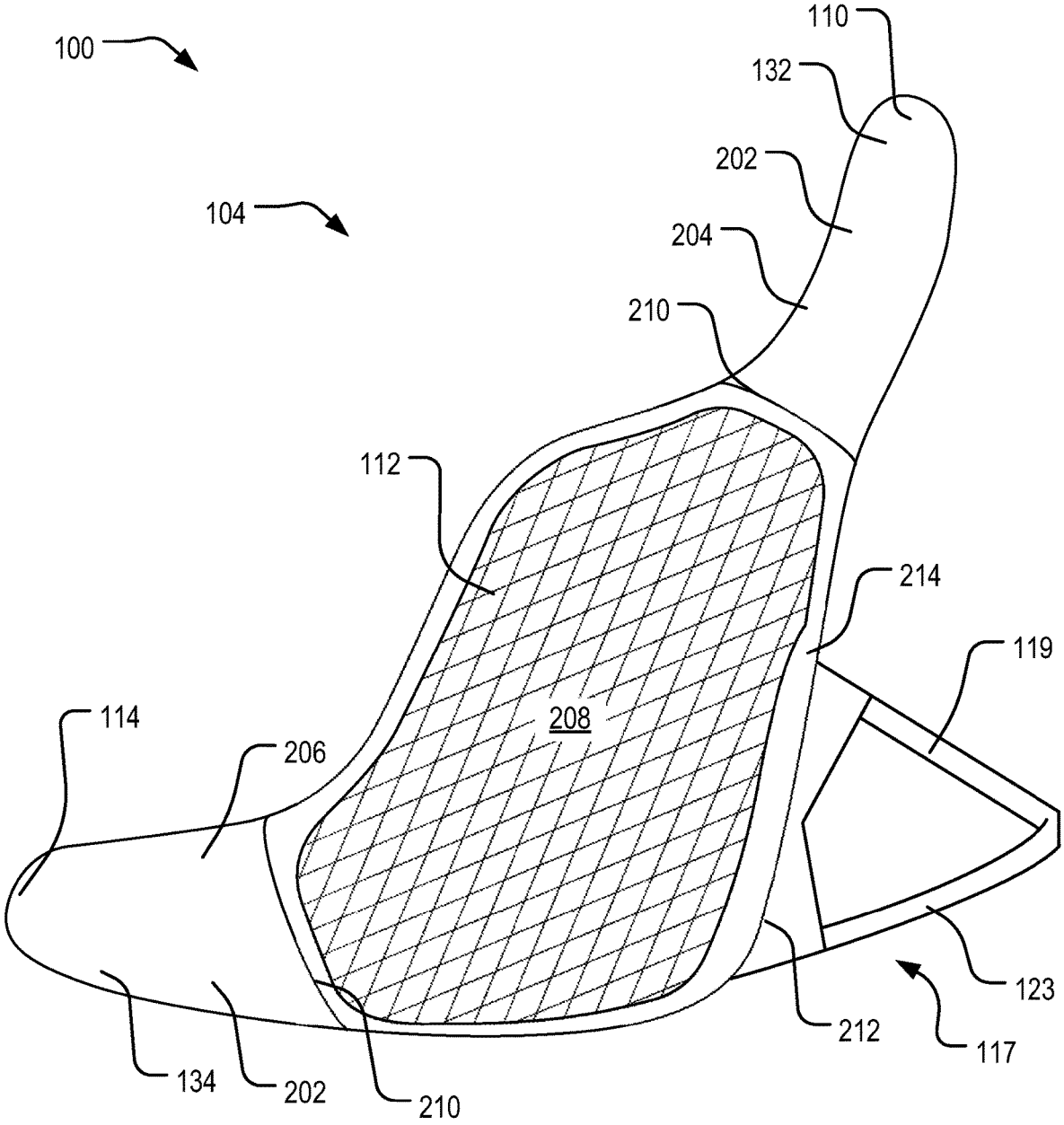
FIG. 2 illustrates a rear side of an example multi-functional carrier bag with one or more carrying positions.
Figure 3A:
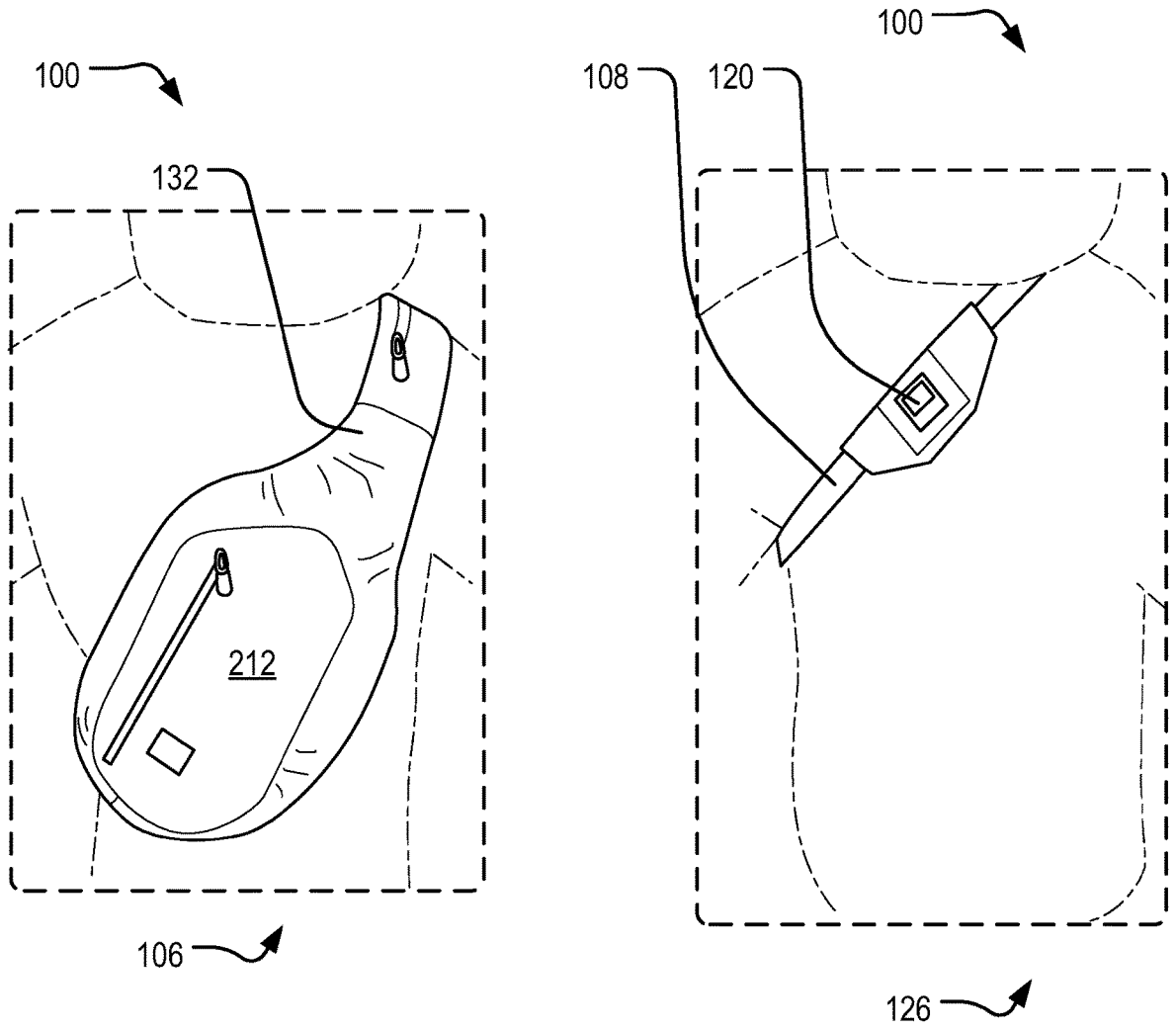
FIG. 3A illustrates an example multi-functional carrier bag being transitioned between a first carrying position to a second carrying position.

FIG. 1 depicts a front side 102 of a multi-functional carrier bag 100 and FIG. 2 depicts a rear side 104 of the multi-functional carrier bag 100. The multi-functional carrier bag 100 can be carried in a first carrying position 106 on the back of a wearer (e.g., as shown in FIG. 3A). In the first carrying position 106, the multi-functional carrier bag 100 can establish a first support with a first stabilizer strap 108 extending from a first end 110 of a central body 112 of the multi-functional carrier bag 100, across a front of a user to a second end 114 of the central body 112 of the multi-functional carrier bag 100. On the user, the first stabilizer strap 108 can extend from an upper left shoulder of the user to a bottom right side, or from an upper right shoulder to a bottom left side. A second stabilizer strap 116 can extend from a side 118 of the central body 112 of the multi-functional carrier bag 100 between the first end 110 and the second end 114 to connect to the first stabilizer strap 108, for instance, at a strap connector 120 coupled to the first stabilizer strap 108. The strap connector 120 can include a connector 129 attached to a fabric or rigid material disposed or looped around a portion of the first stabilizer strap 108, somewhat loosely, such that the strap connector 120 can slide along the first stabilizer strap 108, or the strap connector can be fixedly secured in a static position on the first stabilizer strap 108. Additionally or alternatively, the strap connector 120 can include a plastic, metallic, and/or magnetic connector. The second stabilizer strap 116 can establish a second support around a second side of the user opposite a first side of the first stabilizer strap 108 by connecting to the first stabilizer strap 108 at the strap connector 120 to form a three-point connection at a front position (e.g., a chest position) of a user. Accordingly, the first stabilizer strap 108 and the second stabilizer strap 116 can both be used to maintain the multi-functional carrier bag 100 in the first carrying position 106 and the second position 126. These features can provide multiple points of support, for instance, using the three-point connection or a T-connection 122 on a front chest of the user, and/or resting pressure from the strap sheaths and stabilizing straps.

In some instance, the first stabilizer strap 108 can include a first strap portion 111 extending from the first end 110 and a second strap portion 113 extending from the second end 114. The first strap portion 111 and the second strap portion 113 can extend from the central body 112 of the multi-functional carrier bag 100 to form an angle 115 (e.g., at the central body 112 or a corner of the central body 112 adjacent to a side pocket 124), which can be an obtuse angle, and/or configures the multi-functional carrier bag 100 for carrying in the different carrying positions, by matching the contours and anatomical angles of the body of the user.

Additionally, the multi-functional carrier bag 100 can be transitioned to and carried in a second carrying position 126 over a front of the wearer (e.g., at the wearer's chest, belly, lap, etc.) For instance, in the second carrying position 126, the central body 112 of the multi-functional carrier bag 100 can be positioned across a lap or front belly or chest of the wearer with the first stabilizer strap 108 extending around the back of the wearer. The first stabilizer strap 108 can extend across one shoulder and diagonally across a back of the wearer. In some instances, the second carrying position 126 is a sitting carrying position with the multi-functional carrier bag 100 resting on a lap of the wearer. The second carrying position 126 can also be a standing position. In the second carrying position 126, the second stabilizer strap 116 can be omitted from providing any support, and only the first stabilizer strap 108 can support the multi-functional carrier bag 100 to maintain it in the second carrying position 126.

In some examples, the multi-functional carrier bag 100 is operable to transition between the first carrying position 106 and the second carrying position 126. For instance, the multi-functional carrier bag 100 can have a first configuration of components in the first carrying position 106, and these components can be reconfigured into a second configuration to transition the multi-functional carrier bag 100 from the first carrying position 106 to the second carrying position 126. The reconfigurable components can include the second stabilizer strap 116. In the first carrying position 106, the second stabilizer strap 116 can be exposed and extending away from the central body 112 of the multi-functional carrier bag 100 to attach to the strap connector 120 on the chest of the wearer. The multi-functional carrier bag 100 can be transitioned to the second carrying position 126 by detaching the second stabilizer strap 116 from the strap connector 120; opening a zipper of the side pocket 124 or pouch (e.g., adjacent to attachment points of the second stabilizer strap 116 onto the central body 112 of the multi-functional carrier bag 100); inserting the second stabilizer strap 116 into the side pocket 124 or pouch; securing the second stabilizer strap 116 in the side pocket 124 or pouch (e.g., by closing the zipper); and/or sliding the multi-functional carrier bag 100 around the wearer's body. Conversely, the multi-functional carrier bag 100 can be transitioned from the second carrying position 126 to first carrying position 106 by opening the zipper; extracting the second stabilizer strap 116 from the pocket or pouch; extending the second stabilizer strap 116 (e.g., around the waist of the wearer);

and/or securing the second stabilizer strap 116 to the first stabilizer strap 108 (e.g., forming a three-point connection at the strap connector 120 on the wearer's chest). Furthermore, the multi-functional carrier bag 100 can be transitioned between the first carrying position 106 and the second carrying position 126 by sliding the multi-functional carrier bag 100 around the body (e.g., a circular path around a shoulder of the wearer, diagonally across the torso of the wearer, and around a side of the wearer) and/or rotating the multi-functional carrier bag 100. For instance, the multi-functional carrier bag 100 can be at a different angular rotation/orientation in the second carrying position 126 relative to the first carrying position 106. As such, various zippers, pockets, and other features of the multi-functional carrier bag 100 can be made more easily accessible in the different carrying positions.

In some examples, the multi-functional carrier bag 100 is transitionable between different carrying positions, which can correspond to different activities. For instance, the first carrying position 106 can correspond to a moving activity such as downhill skiing or cross country skiing. The second carrying position 126 can correspond to a rest activity such as sitting on a ski lift or standing to access the central body 112 of the multi-functional carrier bag 100. The components of the multi-functional carrier bag 100 can be specifically configured for usage during the different activities in the different positions. For instance, one or more pocket and/or zipper orientations and pocket shapes 128 can be configured with a first access angle in the first carrying position 106 and/or a second access angle in the second carrying position 126. The pocket shape 128 can have inner seams forming angles and shapes that allow the inner contents to hang (e.g., because of gravity) at a first angle or direction in the first carrying position 106 and at a second angle or direction in the second carrying position 126. In some instances, the pocket shapes 128 can correspond to a ski lift ticket, a hand warmer, personal items like a phone, wallet, keys, gloves, and the like. Pockets 130 of the multi-functional carrier bag 100 can be formed of a mesh material. Additionally, the pockets 130 can include a hydration bladder (e.g., held in the mesh pocket) with a hydration hose 300 extending to one or more hydration ports 302 (e.g., as shown in FIG. 3C). The pocket holding the hydration bladder can be attached to an inside back panel (e.g., an interior side of the rear side 104) of the multi-functional carrier bag 100. One or more hydration ports 302 can be disposed on the multi-functional carrier bag 100 at the central body 112, along the shoulder harness portion (e.g., along a first strap sheath 132), and/or along a side harness portion (e.g., along the second strap sheath 134). In some instances, the hydration port 302 is disposed on a side of the central body 112 opposite the second stabilizer strap 116 and/or it's storage pocket, such that the hydration port is positioned upright (e.g., at a top of the multi-functional carrier bag 100), when the bag is carried in the front position of the user. A hydration hose 300 coupling to the hydration bladder can have a magnetic docking clasp, a plastic or metal clip, or the like, removably holding the hydration hose 300 in place. Additionally, a zipper 136 on the central body 112 can provide access to the internal pocket holding the hydration bladder.

Moreover, the pocket materials or other interior or exterior materials may correspond to the multiple carrying positions for multiple activities. The pocket materials, inner material, and/or exterior material may be water resistant, cold/freeze resistant, and/or include zippers or buttons sized and positioned for access with gloves. For instance, the zipper(s) 136 can include a #8 coil zipper with a storm flap for accessing the main bag pocket in the central body 112. One or more #8 urethane zippers can be used for secondary openings 138 to secondary pockets, such as the phone pocket, the ski pass pocket, and the like. Additionally, the zippers 136 can extend across the multi-functional carrier bag 100 at different angles to provide easy access in the different carrying positions. For instance, a ski pass-shaped pocket 137 (e.g., having a rectangular shape and/or with rounded corners) may be positioned at a bottom left area (e.g., at the second end 114 of the central body 112). An access zipper of the ski pass-shaped pocket 137 can run along the second strap sheath 134 at the second strap portion 113 in a direction generally parallel with an edge of the second strap sheath 134 and/or the second strap portion 113 of the first stabilizer strap 108. A ski pass pocket 137 or other pocket can be configured to be upright (e.g., with a zipper 136 at a side or top of the pocket) in the second carrying position 126; and/or non-upright (e.g., with the zipper 136 facing at least partially downward) in the first carrying position 106. In some instances, a mobile device pocket 139 can have dimensions and/or a material rigidity corresponding to a mobile device shape, such that the pocket is configured to hold a mobile device. The mobile device pocket 139 can be sewn into the multi-functional carrier bag 100, and can include a divider to keep hand warmers in one portion of the mobile device pocket 139, or in other pockets, away from the mobile device (e.g., in another portion of the 139). In other words, a pocket such as the mobile device pocket 139 can include a foam or insulation liner, divider, or other insulator, and/or have a particular zipper access angle, such that the pocket is configured to hold the mobile device. The mobile device pocket 139 can be approximately 6 inches deep and 7 inches wide; and/or can have dimensions that follow contours of the central body 112. Additionally or alternatively, the pocket(s) can be configured with a shape, size, and or insulation liner such that the pocket is configured to hold a hand warmer. A bag area 140 of the multi-functional carrier bag 100 (e.g., formed into the central body 112) can have interior seams to keep contents from migrating to a shoulder harness area and/or the ski pass area formed into one of the ends of the multi-functional carrier bag 100 (e.g., at harness sheaths extending from the ends of the multi-functional carrier bag 100). An electronics device pocket can include a foam liner with one or more nylon dividers inside the pocket to place a heat pack(s) on one or both sides of the electronic device. Additionally, a mesh pocket inside the central body 112 can form a large bag portion of the multi-functional carrier bag 100 with a zippered side 142 extending along a side of the central body 112 to provide access to the mesh pocket.

Additionally, the one or more connectors 144 used for connecting the second stabilizer strap 116 to the strap connector 120 (e.g., and/or the two portions of the first stabilizer strap 108 together) on the first stabilizer strap 108 can be configured for use in cold, wet, icy, and/or snow conditions. For instance, the connectors 144 can be magnetic connectors that can be slid and locked in any conditions. The connectors 144 can include a magnetic buckle such as a magnetic clasp or magnetic Fidlock buckle or a Woojin buckle. Additionally or alternatively, the connectors 144 can include metal push-snap connectors released by pinching inward a spring-loaded side of the connector 144. Use of the magnetic clasp can provide one-handed operations for attaching and detaching the connectors 144, with gloves, and/or in snowy/icy conditions. The second stabilizer strap 116 can include a connector 144 (e.g., which can be a slidable connector 127 or a fixed connector). at a first end for attaching the second stabilizer strap 116 to the strap connector 120 on the first stabilizer strap 108.

In some examples, a second end of the second stabilizer strap 116 can split into the V strap 117 which can be sewn into a zippered storage pocket (e.g., the side pocket 124). The "V" strap 117 and/or fabric webbing or planar surfaces connecting the second end of the second stabilizer strap 116 to the central body 112 can be patterned in a way to keep snow from entering the zippered storage pocket when the multi-functional carrier bag 100 is in the first carrying position 106 (e.g., with the zippered storage pocket unzipped and open to release the second stabilizer strap 116) as well as the second carrying position 126 (e.g., with the zippered storage pocket zipped shut).

Furthermore, the first strap sheath 132 and/or the second strap sheath 134 extension member(s) of the central body 112 can extend non-parallel and/or non-perpendicularly relative to each other, such that the first strap portion 111 and the second strap portion 113 of the first stabilizer strap 108 form the angle 115. The first strap portion 111 and the second strap portion 113 can attach to (e.g., via a sewing seam), and/or be at least partially enclosed by the first strap sheath 132 and/or the second strap sheath 134. Zippers and pockets can also be formed along the first strap sheath 132 extending from the first end 110 of the central body 112 and the second strap sheath 134 extending from the second end 114 of the central body 112. The central body 112, the first strap sheath 132, and/or the second strap sheath 134 can be formed of a continuous material or fabric extending from the first end 110 to the second end 114.

In some instances, the hydration ports 302 can be formed into the first strap sheath 132 (e.g., accessible via a zipper 136), along a side surface of the central body 112 between the first end 110 and the second end 114, along the second strap sheath 134, at one or more junctures between the strap sheath(s) 132 or 134 and the central body 112, or at any combinations thereof.

In some examples, a webbing of material can connect the "V" strap 117 of the second stabilizer strap 116 to the central body 112 (e.g., at a corner formed by the continuous material). Moreover, the connective webbing 148 for the second stabilizer strap 116 can have a length corresponding to a zipper 136 of the pocket for receiving the second stabilizer strap 116 (e.g., being slightly less than a length of the zipper). The V strap 117 can have a first strap 119 coupling to the central body at a first connection point 121, and a second strap 123 coupling to the central body 112 at a second connection point 125. In some examples, the first strap 119 intersects the second strap 123 using a slidable connector 127, which can slide up and down the second strap 123 automatically to adjust to a size of a wearer. The slidable connector 127 can be at or proximate to an end of the first stabilizer strap 108, and can slide unencumbered along the second strap 123 for automatic adjustments to a body shape of a user.

In some scenarios, the rear side 104 of the multi-functional carrier bag 100 can also be formed of water resistant material and/or can be formed of a material for pressing against the wearer, such 104 as a soft foam, a hard foam, or fabric material. For instance, one or more portions of the rear side can be formed of a thermal molded back panel(s) 200. The foam can be a high density polyethylene (HDPE) frame sheet and/or a molded foam such as a 7 mm soft ethylene-vinyl acetate (EVA) foam (e.g., a four-way stretch woven fabric, a porous material, a honeycomb material, etc.) A back side panel 202 of the shoulder portion 204 (e.g., a rear of the first strap sheath 132) and/or the second strap sheath 134 at a hip portion 206 can be formed of a first material, and a central rear panel 208 of the central body 112 can be formed of a second material (which can be different, thicker, or softer than the first material). The rear panels behind the first strap sheath 132 (e.g., the shoulder portion 204) and the second strap sheath 134 (e.g., the hip portion 206) can be movably coupled to the central rear panel 208 of the central body 112 via one or more hinge points 210 (e.g., a living hinge and/or flexible portion). For instance, a shoulder panel and a hip panel can be coupled to the central rear panel 208 with the hinge points 210. Additional structure supports (e.g., rigid frames) can be used in some embodiments to maintain a shape of the multi-functional carrier bag 100. The zipper 212 for the pocket that receives the second stabilizer strap 116 (e.g., the side pocket 124) can run along an edge 214 of the central rear panel 208, traversing into the rear side 104 of the multi-functional carrier bag 100. In some instances, the central body 112 can have an exterior profile shape (e.g., with sharp or rounded corners), such as a hexagon or irregular hexagon, a pentagon, a square, a triangle, an irregular parallelogram, and the like (e.g., defined by the central rear panel 208).

FIGS. 3A-3D depict a wearer using the multi-functional carrier bag 100 and transitioning the multi-functional carrier bag 100 between the different carrying positions (e.g., with one or more one-handed operations).

For instance, FIG. 3A depicts a back of a wearer as the multi-functional carrier bag 100 is transitioned from the first carrying position 106 to the second carrying position 126. The wearer can grab the first stabilizer strap 108 with a left hand and pull the first stabilizer strap 108 in a downward direction to cause the multi-functional carrier bag 100 to spin or slide around the body of the wearer (e.g., from the back of the wearer to the front of the wearer.

Figure 3B:
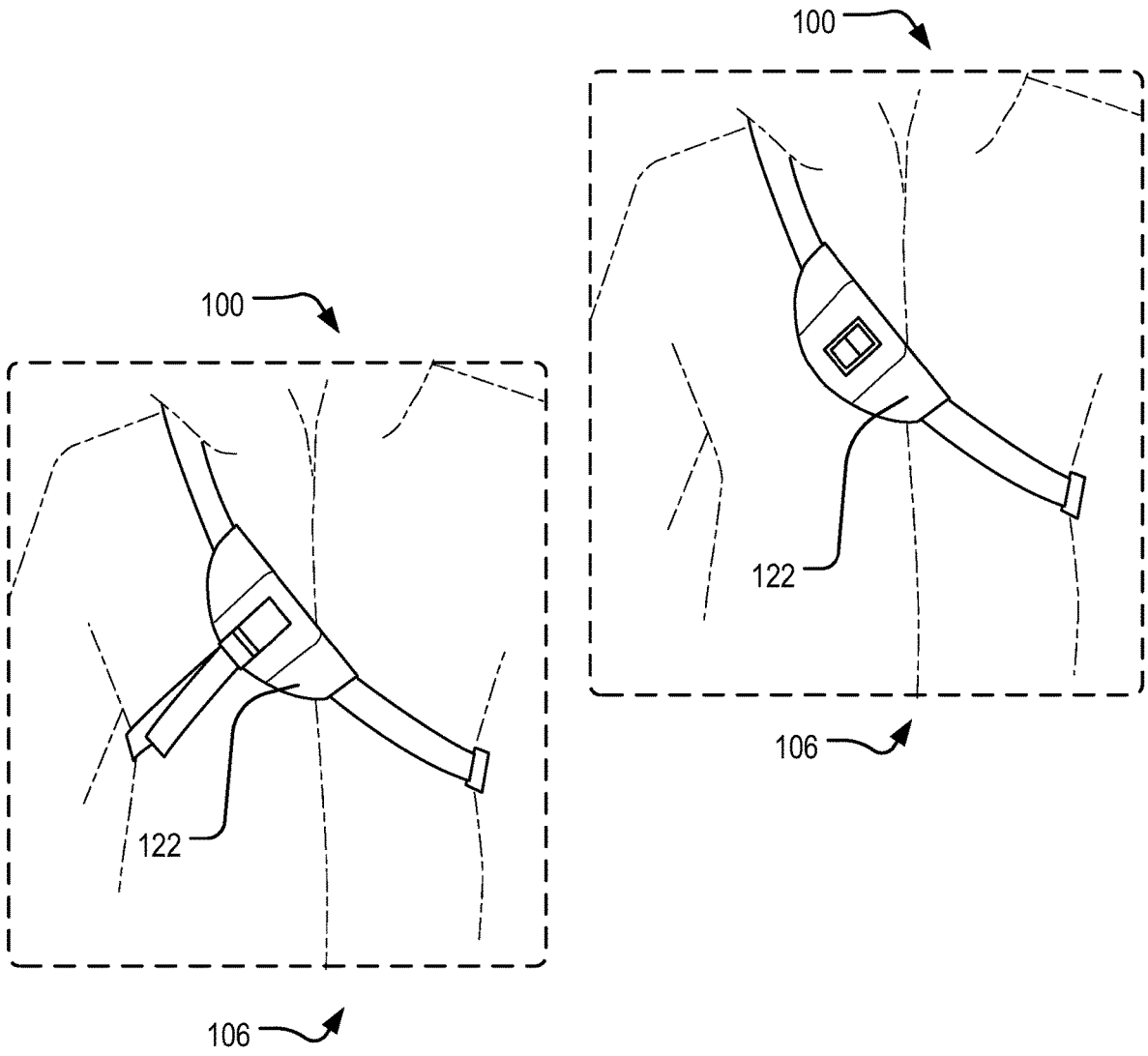
FIG. 3B illustrates an example multi-functional carrier bag being transitioned from a first carrying position to a second carrying position by engaging or disengaging a three-point connection.
Figure 3C:
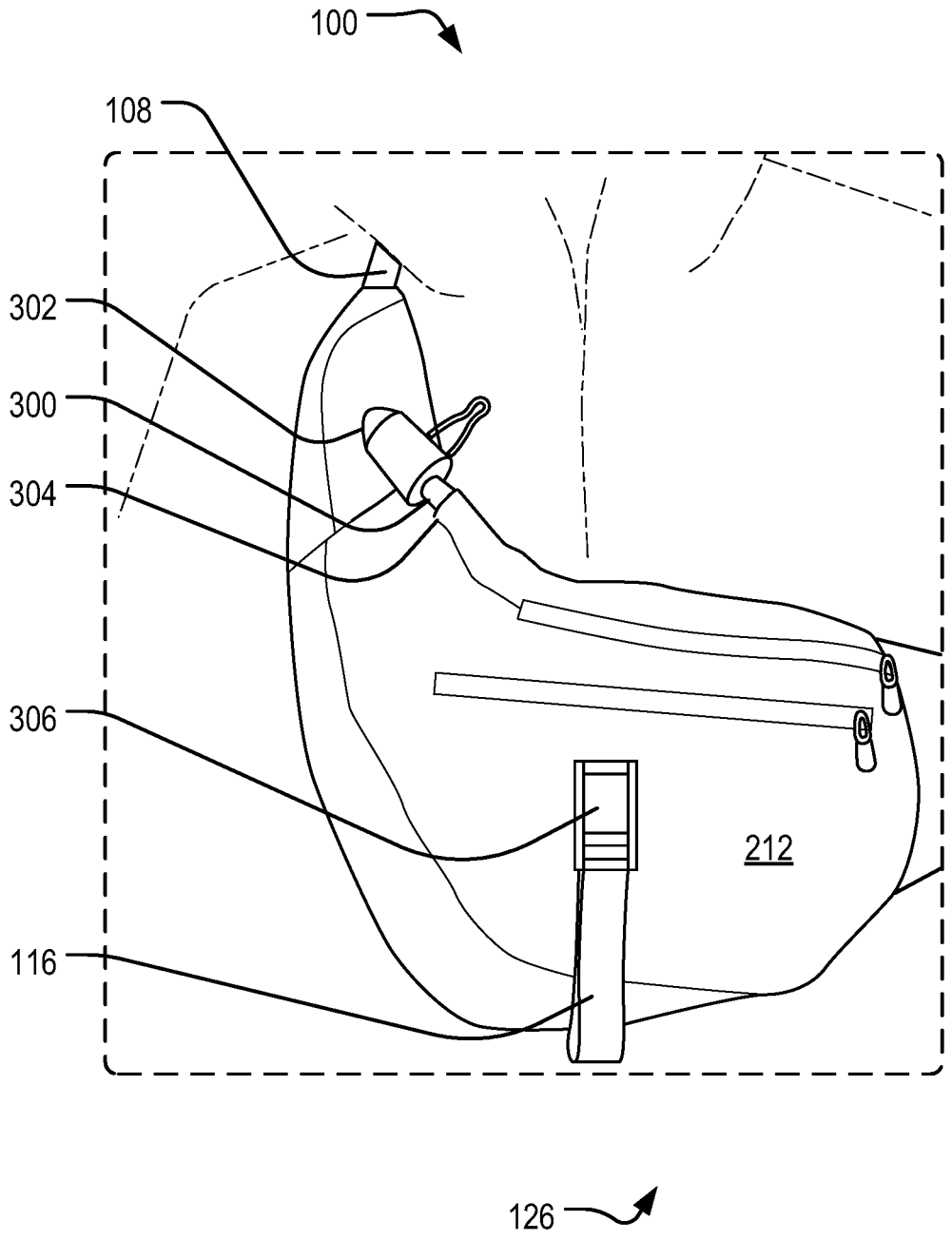
FIG. 3C illustrates an example multi-functional carrier bag in a carrying position with a hydration tube accessible.

FIG. 3B depicts a side and front of a wearer of the multi-functional carrier bag 100. The wearer can disconnect the second stabilizer strap 116 from the strap connector 120 and pull the first stabilizer strap 108 in an upwards direction to cause the multi-functional carrier bag 100 to slide around the body of the wearer, for instance, from the first carrying position 106 into the second carrying position 126.

FIG. 3C depicts a front of a wearer as the multi-functional carrier bag 100 is transitioned into the second carrying position 126. Moreover, FIG. 3C shows the wearer unzipping the access zipper 304 for the hydration hose 300, and attaching the second stabilizer strap 116 to a strap holding connector 306 disposed on the central body 112 of the multi-functional carrier bag 100 (e.g., for strap storage).

Figure 3D:
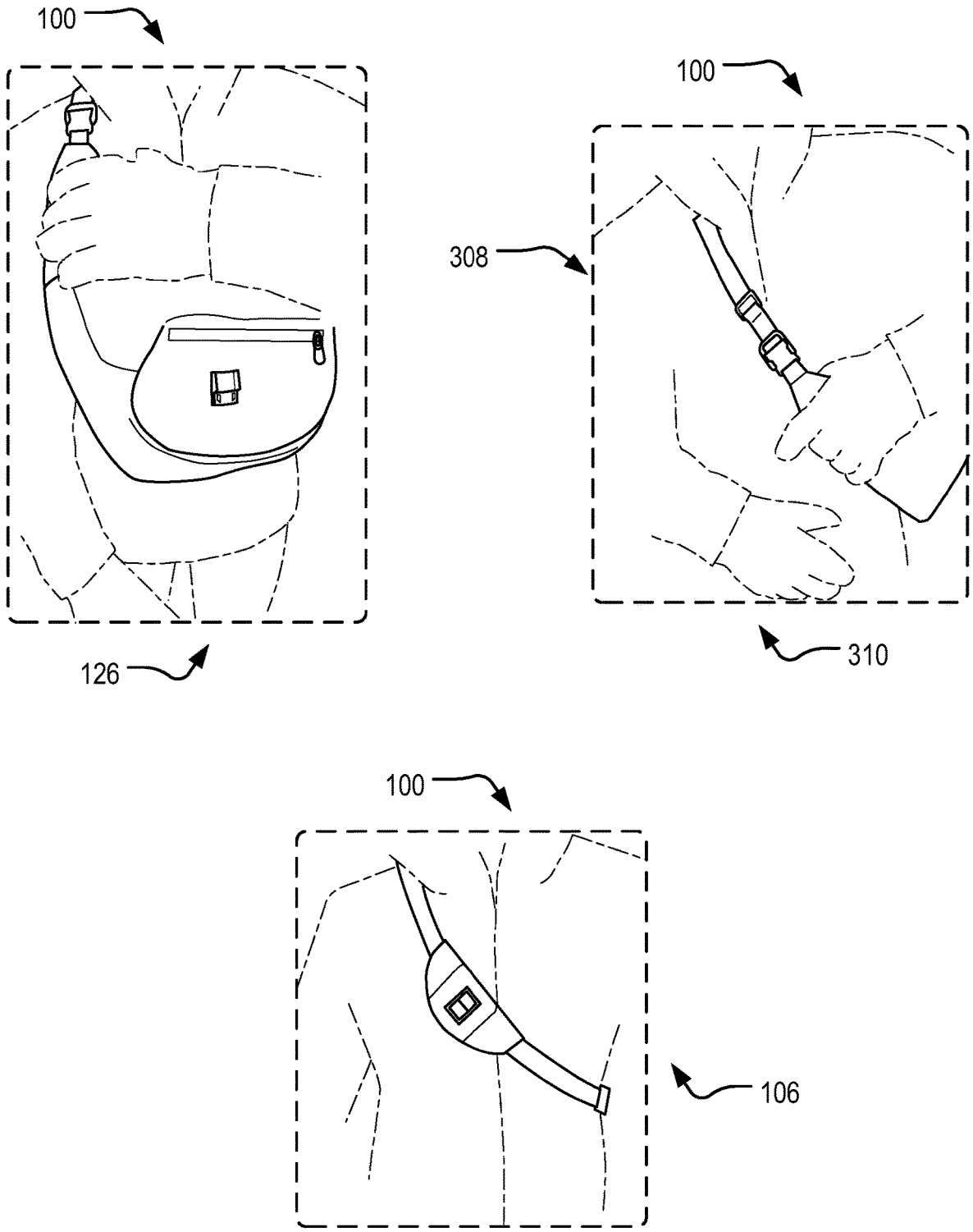
FIG. 3D illustrates an example multi-functional carrier bag being transitioned between multiple carrying positions.

FIG. 3D depicts the multi-functional carrier bag 100 being transitioned from the second carrying position 126 to the first carrying position 106. For instance, with the central body 112 at a front of the wearer, the wearer can grab the central body 112 and/or the first stabilizer strap 108 with their left hand or right hand and pull the central body 112 downward to cause the multi-functional carrier bag 100 to slide around the body of the wearer during a position transition operation 308. This can cause the multi-functional carrier bag 100 to move into a transitional position 310 at a side of the user while transitioning to the back of the wearer. Upon positioning the multi-functional carrier bag 100 on their back, the wearer can connect the second stabilizer strap 116 to the strap connector 120 disposed on the first stabilizer strap 108 (e.g., at the chest of the user).

Additionally or alternatively, the multi-functional carrier bag 100 can also be transitioned from the first carrying position 106 to the second carrying position 126 using a one-handed operation to continue to rotate the multi-functional carrier bag 100 in the same rotational direction around the body and/or in a reverse rotational direction. Moreover, a zipper 136 can be in an upright position (e.g., located at a top of the multi-functional carrier bag 100) when the multi-functional carrier bag 100 is in the second carrying position 126. The wearer can unzip the zipper to access inner contents of the central body 112. Additionally, with the multi-functional carrier bag 100 in the second carrying position 126, the wearer can unzip a zipper 136 and pull the hydration hose 300 from a hydration hose pocket such that the hydration hose extends out of the multi-functional carrier bag 100. The wearer can remove a cap on the hydration hose, replace the cap, and/or retract the hydration hose back into the multi-functional carrier bag 100. The hydration port 302 and/or hydration hose 300 can be stored at and/or extracted from various locations on the multi-functional carrier bag 100, such as from any of the zippers 136 depicted in FIGS. 1-3D, such as on the central body 112 near the first end 110 where the first strap sheath 132 adjoins the central body 112, near the second end 114 where the second strap sheath 134 adjoins the central body 112, at the side opposite the side pocket 124, at any corners or sides of a polygonal shape (e.g., a hexagon) forming a profile of the multi-functional carrier bag 100, and/or combinations thereof.

Figure 4:
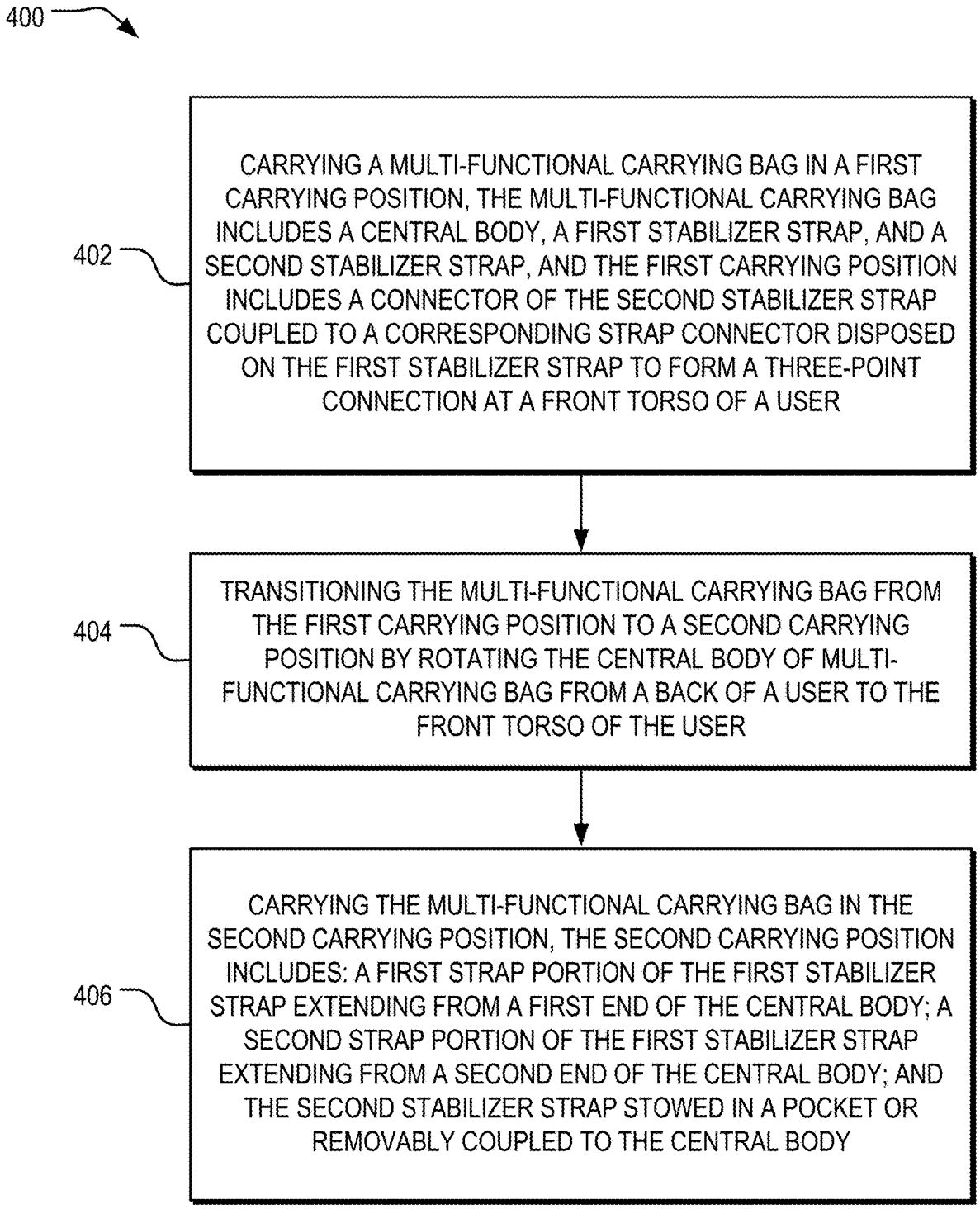
FIG. 4 illustrates an example method of providing a multi-functional carrying system, which can be performed by the systems and devices disclosed in FIGS. 1-3D.

FIG. 4 illustrates an example method 400 for providing the multi-functional carrying bag and systems disclosed herein.

At operation 402, the method 400 can carry a multi-functional carrying bag in a first carrying position, the multi-functional carrying bag including a central body, a first stabilizer strap, and a second stabilizer strap, and the first carrying position includes: a first strap portion of the first stabilizer strap extending from a first end of the central body; a second strap portion of the first stabilizer strap extending from a second end of the central body; and the second stabilizer strap stowed in a pocket or removably coupled to the central body. At operation 404, the method 400 can transition the multi-functional carrying bag from the first carrying position to a second carrying position by rotating the multi-functional carrying bag from a front torso of a user to a rear upper torso of the user. At operation 406, the method 400 can carry the multi-functional carrying bag in the second carrying position, the second carrying position includes a connector of the second stabilizer strap coupled to a corresponding strap connector disposed on the first stabilizer strap to form a three-point connection at the front torso of the user.

It is to be understood that the specific order or hierarchy of steps in the method(s) depicted in FIG. 4 and throughout this disclosure are instances of example approaches and can be rearranged while remaining within the disclosed subject matter. For instance, any of the operations depicted in FIG. 4 and throughout this disclosure may be omitted, repeated, performed in parallel, performed in a different order, and/or combined with any other of the operations depicted in FIG. 4 and throughout this disclosure.

While the present disclosure has been described with reference to various implementations, it will be understood that these implementations are illustrative and that the scope of the present disclosure is not limited to them. Many variations, modifications, additions, and improvements are possible. More generally, implementations in accordance with the present disclosure have been described in the context of particular implementations. Functionality may be separated or combined differently in various implementations of the disclosure or described with different terminology. These and other variations, modifications, additions, and improvements may fall within the scope of the disclosure as defined in the claims that follow.

The invention claimed is:

1. A multi-functional carrier bag comprising:
- a central body at least partially formed of a flexible material;
- a first stabilizer strap including:
  - a first strap portion extending from a first end of the central body; and
  - a second strap portion extending from a second end of the central body, the first strap portion and the second strap portion form an obtuse angle;
- a second stabilizer strap including a first portion extending from the central body from a first connection point, a second portion extending from the central body from a second connection point, and a main portion, the first connection point and the second connection point located at a side of the central body between the first end and the second end, the second stabilizer strap including an intersection of the first portion, the second portion, and the main portion, the main portion of the second stabilizer strap connecting to the first stabilizer strap at a strap connector disposed on the first stabilizer strap for receiving a connector of the second stabilizer strap, wherein the first stabilizer strap and the second stabilizer strap form a three-point connection when worn on a user; and
- a pocket defined into the side of the central body operable to:
  - receive and store the second stabilizer strap when the multi-functional carrier bag is in a first carrying position; and
  - provide access to the second stabilizer strap when the multi-functional carrier bag is in a second carrying position.

2. The multi-functional carrier bag of claim 1, wherein:
- the first end includes a first strap sheath;
- the second end includes a second strap sheath; and
- the first strap sheath and the second strap sheath are continuous extensions of the flexible material at least partially forming the central body.

3. The multi-functional carrier bag of claim 1, further comprising a zipper disposed on the central body with:
- a horizontal orientation in the first carrying position; and
- a non-horizontal orientation in the second carrying position.

4. The multi-functional carrier bag of claim 1, wherein the connector of the second stabilizer strap is:
- unattached to the strap connector when the multi-functional carrier bag is in the first carrying position; and
- attached to the strap connector when the multi-functional carrier bag is in the second carrying position.

5. The multi-functional carrier bag of claim 1, wherein:
- the multi-functional carrier bag further includes a strap holding connector disposed on a front surface of the central body.

6. The multi-functional carrier bag of claim 5, wherein the connector of the second stabilizer strap:
- couples to the strap holding connector disposed on the front surface of the central body when the multi-functional carrier bag is in the first carrying position; and
- couples to the strap connector disposed on the first stabilizer strap when the multi-functional carrier bag is in the second carrying position.

7. The multi-functional carrier bag of claim 5, wherein:

the strap connector is slidably disposed on the first stabilizer strap; and the strap holding connector is fixedly disposed on the front surface of the central body.

8. The multi-functional carrier bag of claim 1, wherein the central body includes an irregular hexagonal-shaped profile.

9. A multi-functional carrying system comprising:

a central body at least partially formed of a flexible material;

a first stabilizer strap including:

a first strap portion extending from a first end of the central body; and a second strap portion extending from a second end of the central body;

a second stabilizer strap extending from the central body between the first end and the second end, the second stabilizer strap including a V strap having a first strap and a second strap, the first strap coupling to the central body at a first connection point and the second strap coupling to the central body at a second connection point, wherein the first strap intersects the second strap with a slidable connector which slides unencumbered along the second strap for automatic adjustments, the second stabilizer strap connecting to the first stabilizer strap at a strap connector disposed on the first stabilizer strap for receiving a connector of the second stabilizer strap, wherein the first stabilizer strap and the second stabilizer strap form a three-point connection when worn on a user;

a pocket defined into a side of the central body and disposed adjacent to the V strap, the pocket operable to:

receive and store the second stabilizer strap when the multi-functional carrying system is in a first carrying position; and provide access to the second stabilizer strap for transitioning the multi-functional carrying system from the first carrying position to a second carrying position wherein, in the second carrying position, the first strap portion of the first stabilizer strap extends from the central body on a back of the user to the three-point connection at a front torso of the user over a shoulder of a first arm of the user, the second strap portion of the first stabilizer strap extends from the central body on the back of the user to the three-point connection at the front torso of the user under a second arm of the user, and the second stabilizer strap extends from the central body on the back of the user to the three-point connection at the front torso of the user under the first arm of the user.

10. The multi-functional carrying system of claim 9, wherein the connector is a magnetic connector, and the strap connector is a magnetic buckle corresponding to the magnetic connector, providing one-handed attachability for the strap connector.

11. The multi-functional carrying system of claim 9, further comprising a first pocket configured for cell phone carrying, and a second pocket configured for a hand warmer, the second pocket having an interior foam divider separating the first pocket from the second pocket and preventing heat transfer from the hand warmer to a contents of the second pocket.

12. A method of providing a multi-functional carrying system, the method comprising:

carrying a multi-functional carrying bag in a first carrying position, the multi-functional carrying bag includes a central body, a first stabilizer strap including a first strap portion extending from a first end of the central body and a second strap portion extending from a second end of the central body, and a second stabilizer strap, and the first carrying position includes a connector of the second stabilizer strap coupled to a corresponding strap connector disposed on the first stabilizer strap, the second stabilizer strap extending from the central body at a side of the central body to the strap connector disposed on the first stabilizer strap to form a three-point connection at a front torso of a user, wherein, in the first carrying position, the first strap portion of the first stabilizer strap extends from the central body on a back of the user to the three-point connection at the front torso of the user over a shoulder of a first arm of the user, the second strap portion of the first stabilizer strap extends from the central body on the back of the user to the three-point connection at the front torso of the user under a second arm of the user, and the second stabilizer strap extends from the central body on the back of the user to the three-point connection at the front torso of the user under the first arm of the user;

transitioning the multi-functional carrying bag from the first carrying position to a second carrying position by rotating the central body of the multi-functional carrying bag from the back of the user to the front torso of the user; and carrying the multi-functional carrying bag in the second carrying position, the second carrying position includes:

the second stabilizer strap stowed in a pocket or removably coupled to the central body;

wherein the second carrying position includes the second stabilizer strap removably coupled to the central body by coupling a first magnetic connector disposed on the second stabilizer strap to a second magnetic connector disposed on an outer surface of the central body.

13. The method of claim 12, wherein:

the connector of the second stabilizer strap couples to the corresponding strap connector using a magnetic connection between the connector and the strap connector; and transitioning the multi-functional carrying bag from the first carrying position to the second carrying position includes performing a one-handed operation.

14. The method of claim 12, further comprising accessing a hydration port, while carrying the multi-functional carrying bag in the second carrying position, disposed on a side of the multi-functional carrying bag opposite the pocket for stowing the second stabilizer strap.

15. The method of claim 12, wherein transitioning the multi-functional carrying bag from the first carrying position to the second carrying position includes:

detaching the connector from the strap connector to disengage the three-point connection at the front torso of the user; and rotating the multi-functional carrying bag from a back upper torso of the user to the front torso of the user.

16. The method of claim 12, further comprising preventing, with a foam liner disposed inside the multi-functional carrying bag, a heat distribution from a first pocket stowing a hand warmer to a second pocket for stowing a mobile device.

* * * * *